US006106185A

United States Patent [19]

Isele et al.

[11] Patent Number: 6,106,185

[45] Date of Patent: Aug. 22, 2000

[54] FITTING FOR A PIECE OF FURNITURE

[75] Inventors: Herbert Isele, Lustenau; Andreas Fenkart, Hohenems, both of Austria

[73] Assignee: Julius Blum Gesellschaft m.b.H., Höchst, Austria

[21] Appl. No.: 09/073,797

[22] Filed: May 7, 1998

[51] Int. Cl.[7] ..... F16B 2/18

[52] U.S. Cl. ..... 403/297; 403/409.1; 403/DIG. 12; 312/334.5

[58] Field of Search ..... 403/297, 409.1, 403/DIG. 12, 230, 231, 322.4, DIG. 8; 312/350, 334.4, 334.5, 334.6, 334.14

[56] References Cited

U.S. PATENT DOCUMENTS

| | | | |
|---|---|---|---|
| 4,370,007 | 1/1983 | Fler | 312/350 X |
| 5,375,922 | 12/1994 | Brustle et al. | 312/334.4 |
| 5,457,867 | 10/1995 | Maberry et al. | 312/350 X |
| 5,611,637 | 3/1997 | Brustle et al. | 403/297 |
| 5,613,796 | 3/1997 | Salice | 403/DIG. 12 X |
| 5,895,103 | 4/1999 | Huber | 403/409.1 X |

FOREIGN PATENT DOCUMENTS

| | | |
|---|---|---|
| 0 755 640 | 1/1997 | European Pat. Off. . |
| 28 33 120 | 2/1980 | Germany . |
| 44 45 736 | 6/1996 | Germany . |
| 2 027 482 | 2/1980 | United Kingdom . |

*Primary Examiner*—Harry C. Kim
*Attorney, Agent, or Firm*—Wenderoth, Lind & Ponack, L.L.P.

[57] ABSTRACT

A fitting for a piece of furniture is provided with at least one separate dowel, which is inserted into a hole of a furniture part. An expansion member is positioned within the dowel. The expansion member is connected to a lever with an eccentric cam by an axle. The dowel is pressed against a plate like part of the fitting. When the dowel is in an expanded position, the lever is situated in a recess of the plate like part. The recess is in the form of a slot. The dowel is positioned at one end of the slot and the plate like part has a casing at the same end of the slot. The expansion member protrudes through a bottom plate of the casing and the axle is situated within the casing so that the dowel abuts the bottom plate of the casing.

13 Claims, 5 Drawing Sheets

10
13
7
3
5

A
3
13
1
7
3

A
13
7

1
3
13
7
10

FITTING FOR A PIECE OF FURNITURE

BACKGROUND OF THE INVENTION

The invention relates to a fitting for a piece of furniture with at least one separate dowel that can be inserted into a hole in a furniture part, and more particularly to a fitting with a slim profile.

SUMMARY OF THE INVENTION

It is the object of the invention to provide a very slim fitting that can be fastened to a furniture wall without requiring a tool and that does not protrude far from the furniture wall.

The invention achieves this object by having a fitting with a recess that is in the form of a slot formed in a plate like part. The fitting includes an expansion member positioned within a dowel. The expansion member is connected to a lever with an eccentric cam by means of an axle. The dowel is held against the plate like part of the fitting, and the dowel is positioned at one end of the slot. A casing is positioned at the same end of the slot. The expansion member protrudes through a bottom plate (bottom portion) of the casing, and the axle is situated within the casing. When mounting the fitting, the casing is pressed into a hole in a furniture part in order to position the fitting. In a locked position, the lever is situated in the recess of the plate like part and the dowel is expanded.

The fitting according to the invention is especially useful for fastening slim parts which carry heavy loads. For example, the fitting is useful for fastening support rails of pull-out guides for a drawer. Further, if the casing is inserted into a hole in the side wall of a piece of furniture, the fitting is able to absorb relatively strong forces which act downwardly. Because the lever in the locked position is situated within a slot of the plate like part, there are no protruding parts which could obstruct the running of rollers fastened to a pull-out rail.

To facilitate mounting of the dowel on the expansion member, a preferred embodiment of the invention provides that the dowel is provided with a cavity that extends through the dowel in longitudinal direction and that the cavity is open towards a side of the dowel. The expansion member is situated within and extends through the cavity at opposite ends of the cavity.

A further embodiment of the invention provides that the plate like part is provided with a protrusion (bump portion) on two sides of the casing, and the protrusion is directed away from the furniture part. The protrusion allows the plate like part to be pressed elastically onto the furniture part.

DESCRIPTION OF THE PREFERRED EMBODIMENT

Figures 1, 2, 3, 4:
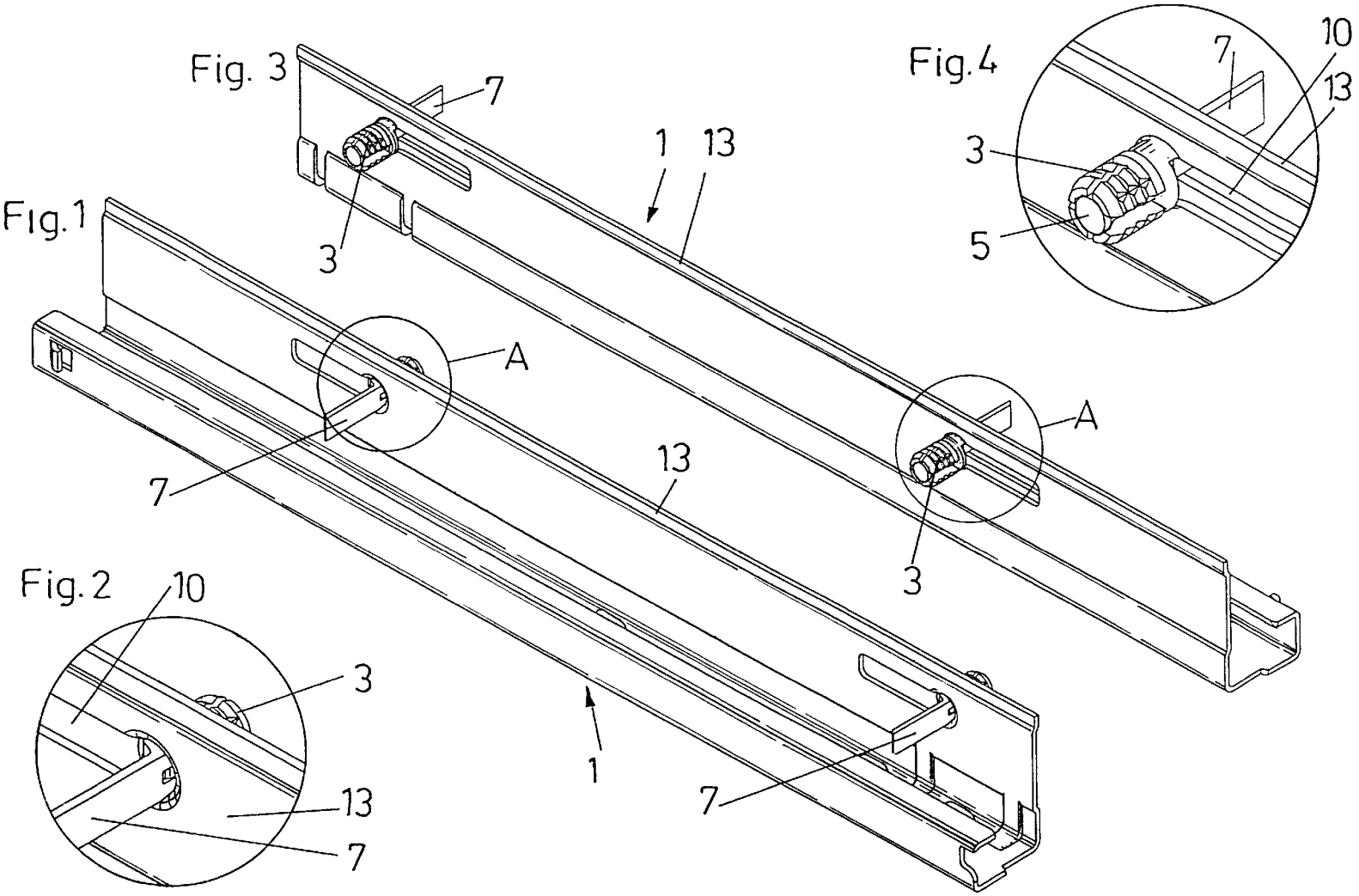
FIG. 1 shows a perspective view of a fitting in an embodiment of a support rail for a pull-out guide assembly for a drawer.
FIG. 2 is an enlarged view of detail A of FIG. 1.
FIG. 3 is a perspective view showing the support rail from another side.
FIG. 4 is an enlarged view of detail A of FIG. 3.
Figure 6:
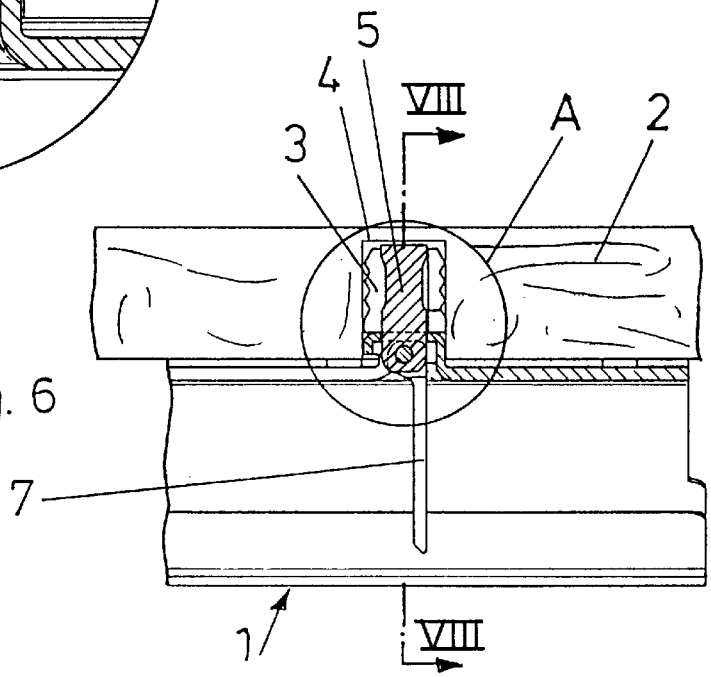
FIG. 6 is a section through the fitting in a mounted position.
Figure 13:
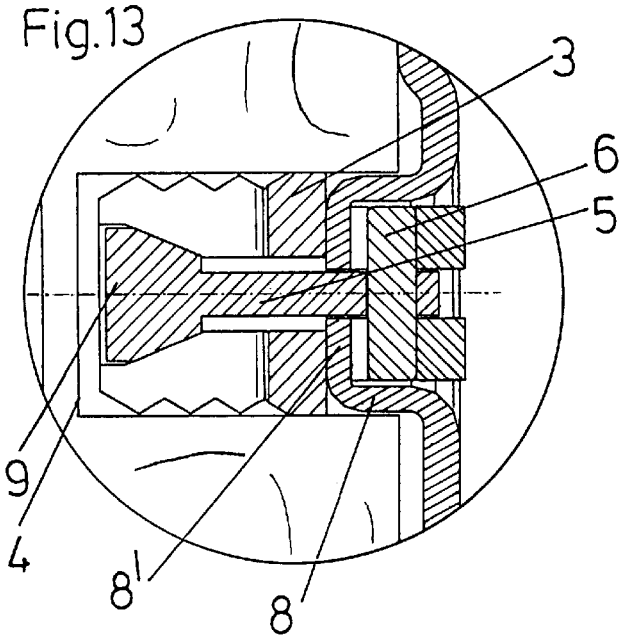
FIG. 13 is an enlarged section of detail A of FIG. 12.
Figure 12:
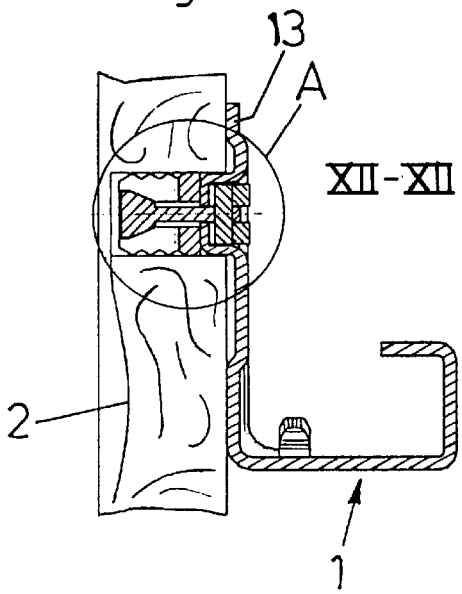
FIG. 12 is a section taken along line XII—XII of FIG. 10.
Figure 11:
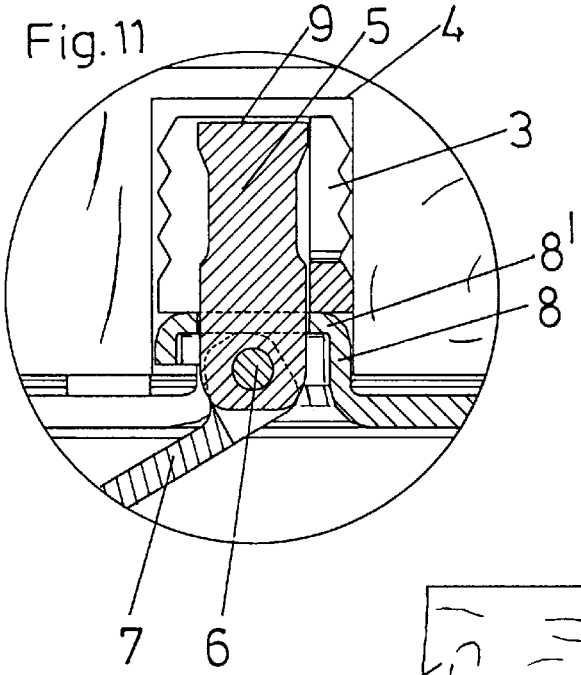
FIG. 11 is an enlarged section of detail A of FIG. 10.
Figure 10:
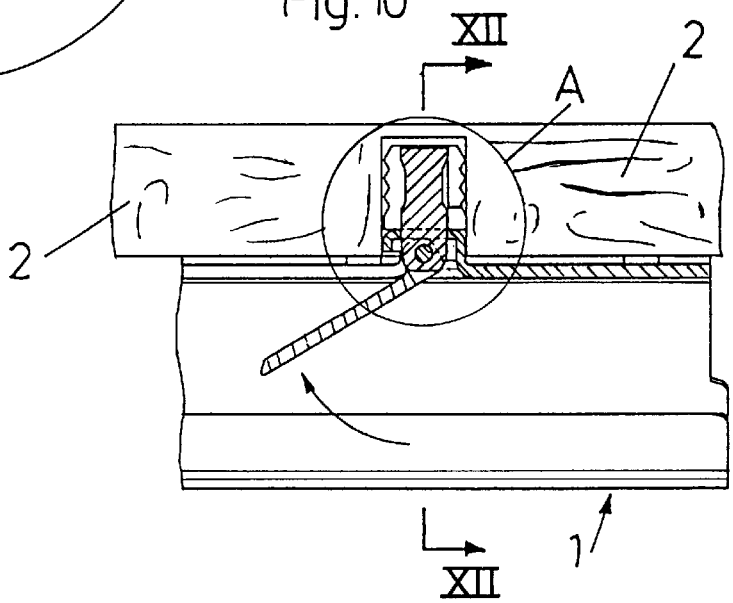
FIG. 10 is a horizontal sectional view of the fitting with a lever being shown in an intermediate position.

In an embodiment shown in FIG. 1, a fitting 1 can include a support rail of a pull-out guide assembly for a drawer, and the support rail is fastened to a furniture side wall. The furniture side wall is furniture part 2 (FIG. 6). The fitting 1 includes a plate like part or flange 13 which abuts two dowels 3. The dowels 3 are inserted into holes 4 (FIG. 6) in the furniture part 2 in order to fasten the fitting 1 (support rail) to the furniture part 2.

The dowels 3 are mounted on the fitting 1 by means of expansion members 5. The expansion members 5 are connected to levers 7 with eccentric cams by means of axles 6. Each axle 6 is situated within a cylindrical casing 8, and the casing 8 is formed in the plate like part 13. When the fitting 1 is mounted, the casing 8, along with the dowel 3, is inserted into the hole 4. The dowel 3 abuts a bottom plate 8' of the casing 8.

When the lever 7 is moved to a locked position, the expansion member 5 moves towards the plate like part 13 and the dowel 3 expands in order to fasten the fitting 1. The plate like part 13 is provided with a slot 10 that extends away from the casing 8. When in the locked position (expanded position), the lever 7 is situated within the slot 10. The slot 10 is longer than the lever 7 to make it easier to grip the free end of the lever 7 when the lever 7 is in the locked position. The ends of the axle 6 are spaced away from the side wall of the casing 8, so that the axle 6 can be moved within the casing 8.

In an unlocked position (non-expanded position), the lever 7 protrudes approximately perpendicular from the fitting 1 and is orientated in line with the dowel 3. This situation is shown in FIGS. 1 to 4. In this unlocked position, the dowels 3 can be inserted into the holes 4 in the furniture part 2, and the fitting 1 can be mounted on the furniture part 2. For locking or fastening the fitting 1 on the furniture part 2, the levers 7 are tilted until they are situated within the slots 10. Tilting the levers 7 outwardly pulls the expansion members 5 within the holes 4, and the dowels 3, which abut the bottom plates 8' of the casings 8, expand. The expanding dowels 3 are pressed against the walls of the holes 4. Thus, the fitting 1 is fastened to the furniture part 2.

Figure 5:
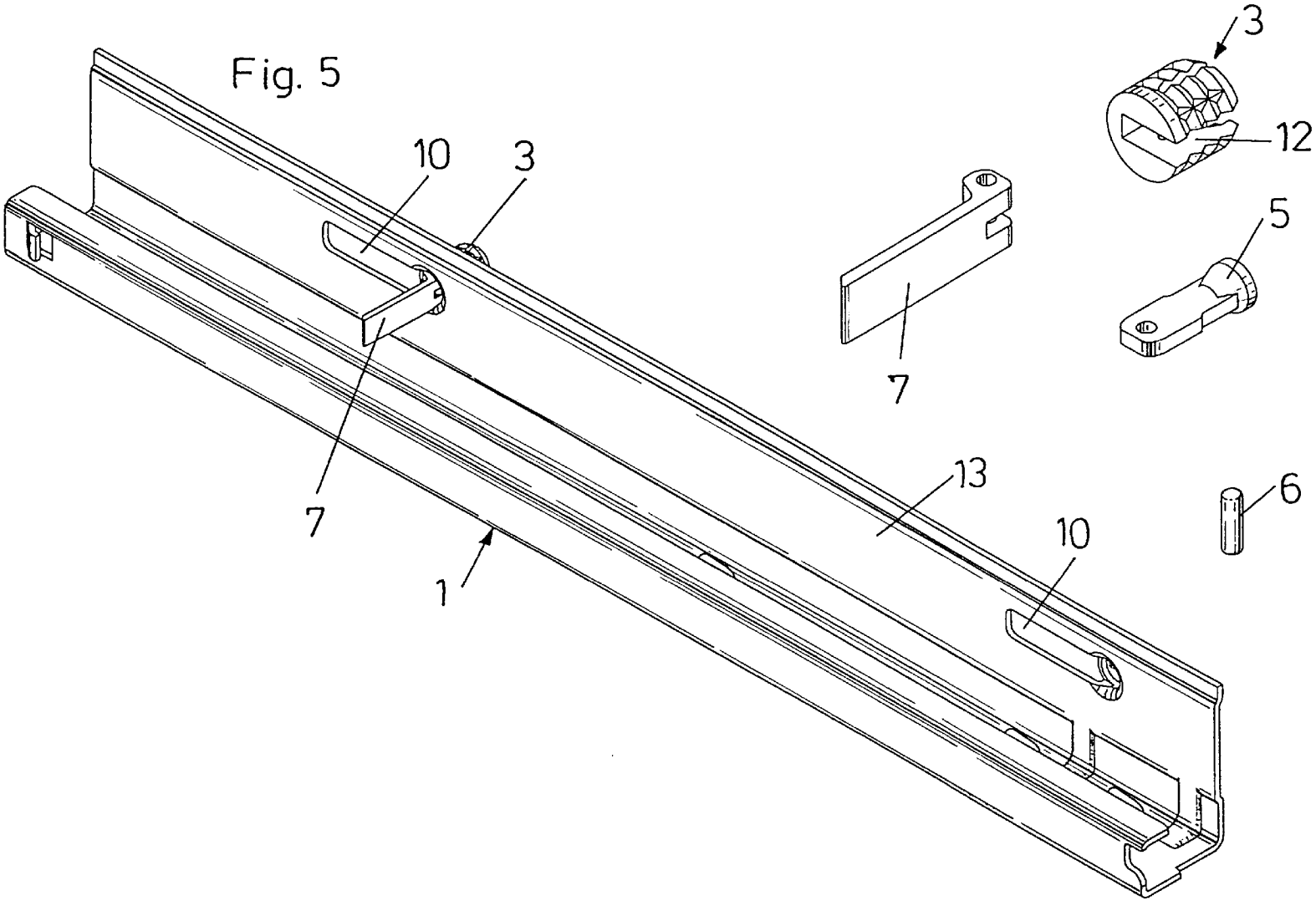
FIG. 5 is an exploded perspective view of the fitting according to the invention.
Figure 9:
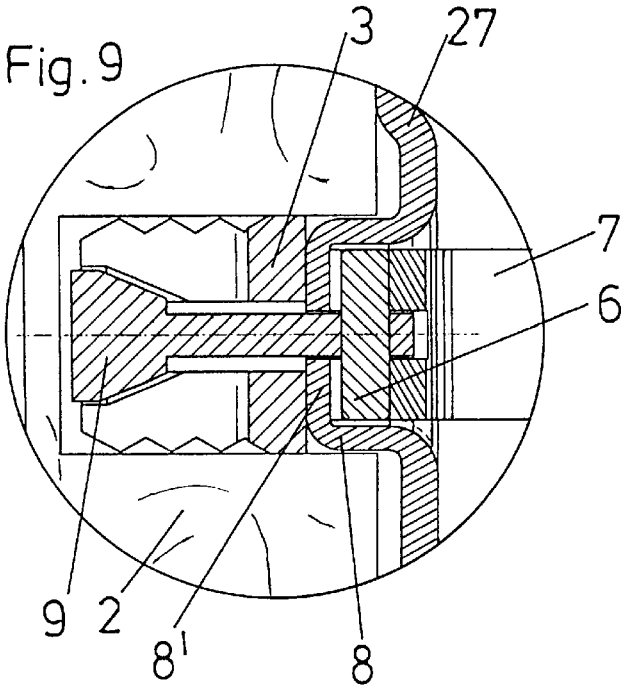
FIG. 9 is an enlarged section of detail A of FIG. 8.
Figure 8:
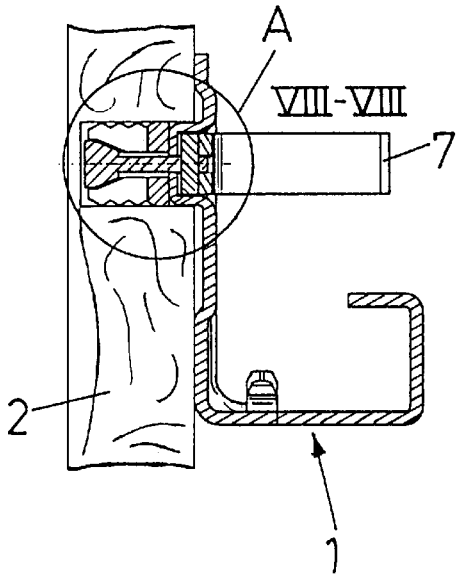
FIG. 8 is a section taken along line VIII—VIII of FIG. 6.
Figure 7:
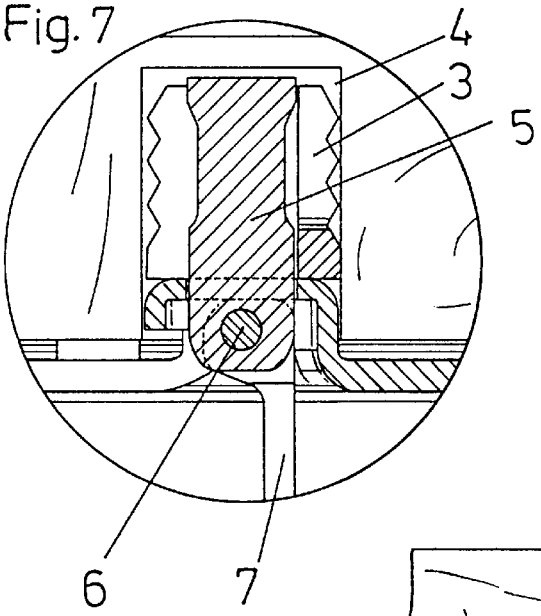
FIG. 7 is an enlarged section of detail A of FIG. 6.
Figure 19:
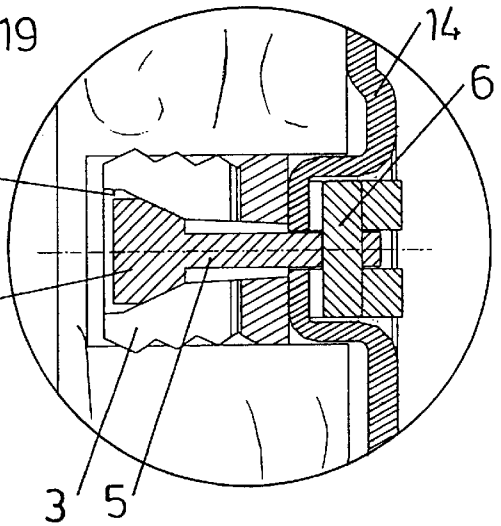
FIG. 19 is an enlarged section of detail A of FIG. 18.
Figure 15:
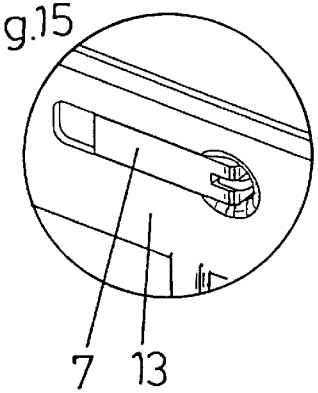
FIG. 15 is an enlarged view of detail A of FIG. 14.
Figure 14:
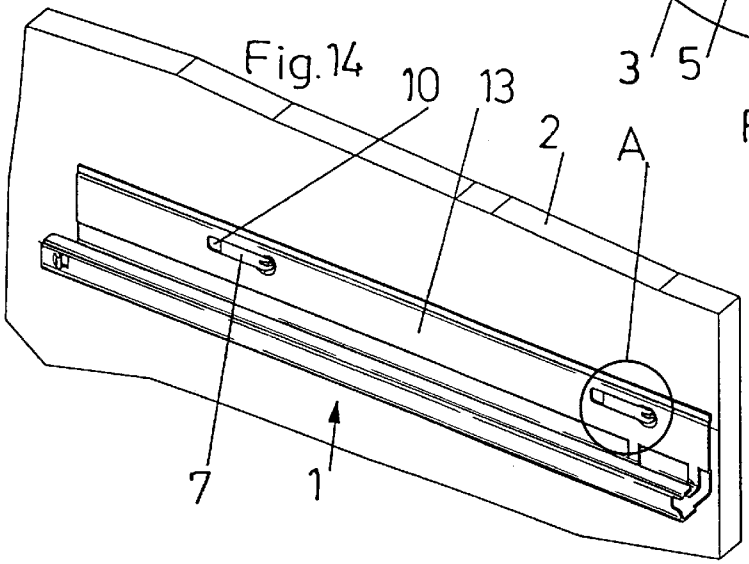
FIG. 14 is a perspective view of the fitting according to the invention mounted on a furniture part.
Figure 18:
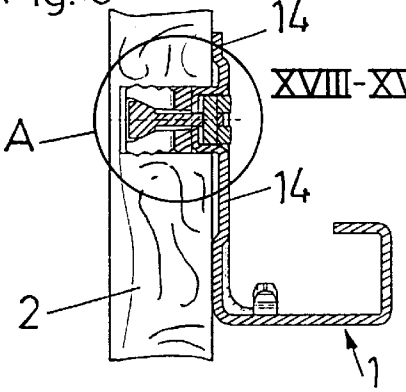
FIG. 18 is a section taken along line XVIII—XVIII of FIG. 16.
Figure 16:
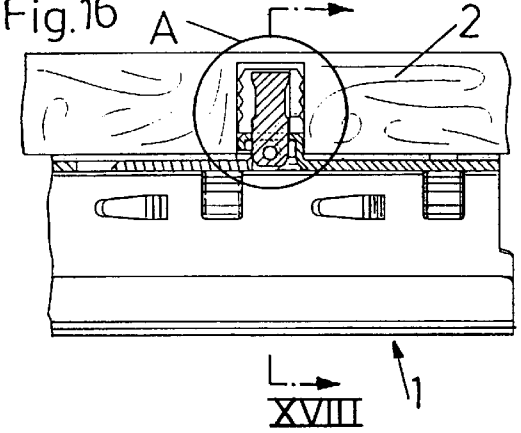
FIG. 16 is a horizontal sectional view of the fitting and of the furniture part.
Figure 17:
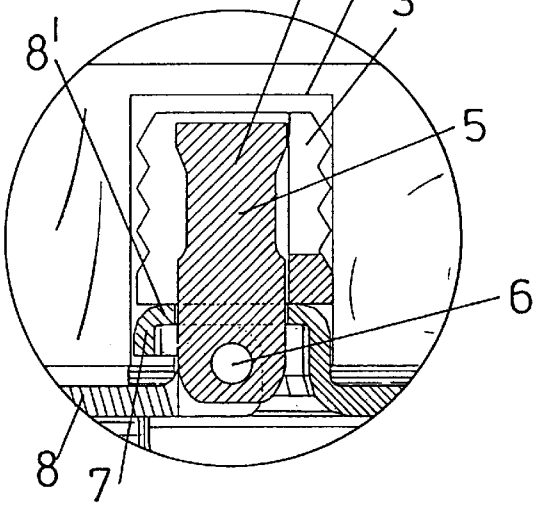
FIG. 17 is an enlarged section of detail A of FIG. 16.

The expansion members 5 are provided with truncated cone shaped ends 9 which are situated in corresponding recesses 11 of the dowels 3 (FIG. 19). Each dowel 3 is provided with a cavity 12 that extends through the dowel 3 in a longitudinal direction and that is open towards a side of the dowel 3 (FIG. 5). Each expansion member 5 is situated within the cavity 12 of the dowel 3, and the ends of the expansion member 5 protrude from the dowel 3 at opposite ends. The plate like part 13 of the fitting 1 is provided with two protrusions 14 which are situated underneath and above the casing 8 (FIGS. 18 and 19). These protrusions 14 are shown as outwardly bent portions of the plate like part 13. These bent up portions allow the plate like part 13 to be pressed elastically towards the furniture part 2 when the dowels 3 are expanded. When in the locked position, the levers 7 are flush with a surface of the plate like part 13.

What is claimed is:

1. A fitting for a piece of furniture having a furniture part with a hole, comprising:

a plate like part having a slot, a casing to be inserted into the hole in the furniture part, said casing protruding from a side of said plate like part that is to be directed toward the furniture part, said casing being provided at one end of said slot, and said casing having a bottom portion;

a dowel abutted against said bottom portion of said casing and adapted to be insertable into the hole in the furniture part;

an expansion member provided within said dowel and passing through said bottom portion of said casing; and a lever connected to said expansion member by an axle, wherein said axle is provided within said casing, wherein said lever has an eccentric cam, and wherein said lever is moveable to a locked position in which said lever is positioned within said slot.

2. A fitting as claimed in claim 1, wherein said dowel is provided with a cavity extending through said dowel in a longitudinal direction with respect to said dowel, wherein said cavity is open towards a side of said dowel, and wherein said expansion member extends through said cavity at both ends of said cavity.

3. A fitting as claimed in claim 1, wherein said plate like part includes protrusions provided on opposite sides of said casing, and wherein each said protrusion extends away from said side.

4. A fitting as claimed in claim 3, wherein each said protrusion includes an outwardly bent portion.

5. A fitting as claimed in claim 1, wherein said axle has ends, wherein said casing has a wall, and wherein said ends of said axle are spaced apart from said wall of said casing.

6. A fitting as claimed in claim 1, wherein said plate like part has a surface, and wherein said lever in said locked position is flush with said surface of said plate like part.

7. A fitting as claimed in claim 1, wherein said plate like part is part of a support rail of a pull-out guide assembly of a drawer.

8. A fitting as claimed in claim 1, wherein said slot is longer than said lever.

9. A fitting as claimed in claim 1, wherein said expansion member includes a truncated cone shaped end.

10. A fitting as claimed in claim 1, wherein said lever is moveable to an unlocked position in which said lever is oriented in line with said dowel.

11. A fitting as claimed in claim 1, wherein said slot is open to a side of said plate like part opposite to said side.

12. A fitting as claimed in claim 9, wherein said axle is provided within said casing at said side of said plate like part.

13. A fitting as claimed in claim 1, wherein said casing has a cylindrical shape.

* * * * *